US009513574B2

(12) United States Patent
Sugiyama et al.

(10) Patent No.: US 9,513,574 B2
(45) Date of Patent: Dec. 6, 2016

(54) IMAGE FORMING APPARATUS

(71) Applicants: Hiroyuki Sugiyama, Kanagawa (JP); Shigekazu Koguchi, Kanagawa (JP); Masahiko Shakuto, Kanagawa (JP); Shinji Minami, Kanagawa (JP); Tomoko Takahashi, Kanagawa (JP); Yoshinori Nakagawa, Kanagawa (JP); Ryuji Yoshida, Kanagawa (JP); Taichi Urayama, Kanagawa (JP)

(72) Inventors: Hiroyuki Sugiyama, Kanagawa (JP); Shigekazu Koguchi, Kanagawa (JP); Masahiko Shakuto, Kanagawa (JP); Shinji Minami, Kanagawa (JP); Tomoko Takahashi, Kanagawa (JP); Yoshinori Nakagawa, Kanagawa (JP); Ryuji Yoshida, Kanagawa (JP); Taichi Urayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/539,330

(22) Filed: Nov. 12, 2014

(65) Prior Publication Data

US 2015/0139674 A1 May 21, 2015

(30) Foreign Application Priority Data

Nov. 18, 2013 (JP) ..... 2013-237560

(51) Int. Cl.
*G03G 15/02* (2006.01)
*G03G 15/06* (2006.01)
(Continued)

(52) U.S. Cl.
CPC ..... *G03G 15/065* (2013.01); *G03G 15/0266* (2013.01); *G03G 15/50* (2013.01); *G03G 15/0121* (2013.01)

(58) Field of Classification Search
CPC ..... G03G 15/065; G03G 15/0266
See application file for complete search history.

(56) References Cited

U.S. PATENT DOCUMENTS 4,432,634 A * 2/1984 Tabuchi ..... G03G 15/065 347/131
5,305,060 A * 4/1994 Fukushima ..... G03G 15/0105 347/115
(Continued)

FOREIGN PATENT DOCUMENTS

JP 4-073669 3/1992
JP 10-171313 6/1998
(Continued)

OTHER PUBLICATIONS

U.S. Appl. No. 14/529,847, filed Oct. 31, 2014, Sugiyama, et al.
Extended European Search Report issued Jul. 17, 2015 in Patent Application No. 14192932.3.

*Primary Examiner* — David Gray
*Assistant Examiner* — Sevan A Aydin
(74) *Attorney, Agent, or Firm* — Oblon, McClelland, Maier & Neustadt, L.L.P.

(57) ABSTRACT

An image forming apparatus includes an electrostatic latent image bearer; a charger to charge a surface of the electrostatic latent image bearer; a power source to output a charging bias supplied to the charger; an electrostatic latent image writing unit to write an electrostatic latent image on the surface of the electrostatic latent image bearer charged by the charger; a developing unit including a developing member to develop the electrostatic latent image to obtain a toner image; a developing power source to output a developing bias supplied to the developing unit; a processor to adjust the charging bias output from the power source to a predetermined target value; and a storage unit to store an adjustment value algorithm.

5 Claims, 8 Drawing Sheets

(51) Int. Cl.
*G03G 15/00* (2006.01)
*G03G 15/01* (2006.01)

(56) References Cited

U.S. PATENT DOCUMENTS

| | | | | |
|---|---|---|---|---|
| 5,899,596 | A | 5/1999 | Thompson | |
| 8,155,551 | B2 * | 4/2012 | Verheijen | G03G 15/5004 323/283 |
| 2001/0024579 | A1 * | 9/2001 | Onuki | G03G 15/0266 399/50 |
| 2004/0042813 | A1 | 3/2004 | Takai | |
| 2004/0218940 | A1 | 11/2004 | Kosugi et al. | |
| 2005/0089341 | A1 | 4/2005 | Choi | |
| 2011/0058832 | A1 | 3/2011 | Suzuki et al. | |
| 2014/0064756 | A1 | 3/2014 | Sugiyama et al. | |
| 2014/0348521 | A1 | 11/2014 | Mase et al. | |

FOREIGN PATENT DOCUMENTS

| | | |
|---|---|---|
| JP | 2006-039099 | 2/2006 |
| JP | 2006-098970 | 4/2006 |
| JP | 2010-237495 | 10/2010 |
| JP | 2013-005647 | 1/2013 |

* cited by examiner

IMAGE FORMING APPARATUS

CROSS-REFERENCE TO RELATED APPLICATIONS

This patent application is based on and claims priority pursuant to 35 U.S.C. §119 from Japanese Patent Application No. 2013-237560, filed on Nov. 18, 2013 in the Japan Patent Office, which is hereby incorporated by reference herein in its entirety.

BACKGROUND

1. Technical Field

Exemplary embodiments of the present disclosure generally relate to an image forming apparatus.

2. Description of the Related Art

Image forming apparatuses are known that employ an electrophotographic process as described below to form a toner image. That is, a surface of a photoreceptor serving as an electrostatic latent image bearer is uniformly charged by a charging device to an appropriate value by output of a charging bias having a value approximately the same as a target value from a power source. Then, by optically scanning the uniformly charged surface of the photoreceptor with a writing light beam, an electrostatic latent image is formed on the surface of the photoreceptor. Next, the electrostatic latent image on the surface of the photoreceptor is moved to a developing position opposite a developing device and the electrostatic latent image is developed with the developing device to obtain a toner image.

It is to be noted that, in developing by outputting a developing bias having a value approximately the same as a target value from a developing power source and supplying the developing bias to a developing roller of the developing device, an appropriate potential difference is generated between the developing roller and a background portion of the photoreceptor. Accordingly, toner adherence to the background portion of the photoreceptor called background fogging is suppressed. After obtaining the toner image on the surface of the photoreceptor by developing, the toner image is transferred from the surface of the photoreceptor to a recording sheet between a transfer roller and the photoreceptor.

Other types of image forming apparatuses also employ an electrophotographic process to form a toner image, but include a mechanism to suppress a transfer bias output error from a transfer power source. More specifically, in the transfer power source that outputs the transfer bias applied to a transfer roller, error is generated with respect to each transfer bias output value due to individual differences of voltage dividing resistances. In order to respond to such, a controller reads an adjustment value investigated and obtained in advance from prior tests from a nonvolatile memory. By adjusting a control signal that is output to the transfer power source based on the adjustment value, actual output value of the transfer bias approaches a target value, and transfer bias output error is suppressed.

Output error is not specific to the transfer power source and may be generated in the power source or the developing power source. Generally, in the field of image forming apparatuses, power sources having an output within +−3% with respect to a target output are widely employed to keep manufacturing costs low. In other words, an output value of the charging bias or the developing bias may be off by approximately +−3% from a target value, respectively.

When the charging bias is off from the target value, an aimed value of a potential of a background portion of the photoreceptor is off. When the developing bias is off from the target value, an aimed value of a potential of a surface of the developing roller is off. Accordingly, when the aimed value of the potential of the background portion of the photoreceptor or the aimed value of the potential of the surface of the developing roller is off, excess or deficiency may be generated in a background potential that is a potential difference between the surface of the developing roller and the background portion of the photoreceptor.

As a result, however, various problems may occur. For example, when the background potential is insufficient, toner on a surface of the developing roller transfers to a surface of the background portion of the photoreceptor, generating background fogging. In a case in which a two-component development method employing a two-component developer including toner and magnetic carrier is used, when the background potential is excessive, a phenomenon called carrier adhesion occurs, in which magnetic carrier of the two-component developer on the surface of the developing roller transfers to the surface of the photoreceptor.

SUMMARY

In view of the foregoing, in an aspect of this disclosure, there is provided a novel image forming apparatus including an electrostatic latent image bearer; a charger to charge a surface of the electrostatic latent image bearer; a power source to output a charging bias supplied to the charger; an electrostatic latent image writing unit to write an electrostatic latent image on the surface of the electrostatic latent image bearer charged by the charger; a developing unit including a developing member to develop the electrostatic latent image to obtain a toner image; a developing power source to output a developing bias supplied to the developing unit; a processor to adjust the charging bias output from the power source to a predetermined target value, to adjust the developing bias output from the developing power source to a predetermined target value, and to conduct an adjustment process of adjusting a target value of the charging bias or adjusting a target value of the developing bias at a predetermined timing to stabilize image density; and a storage unit to store an adjustment value algorithm. The adjustment value algorithm is an algorithm used to determine an adjustment value to decrease an amount of deviation of a background potential from an optimal background potential, due to output error with respect to the charging bias and output error with respect to the developing bias, by adjusting one of the target value of the charging bias adjusted in the adjustment process and the target value of the developing bias adjusted in the adjustment process in accordance with a combination thereof, the background potential being a potential difference between a surface of the developing member and a background portion of the electrostatic latent image bearer. The processor adjusts one of the target value of the charging bias adjusted in the adjustment process and the target value of the developing bias adjusted in the adjustment process with the adjustment value determined with the adjustment value algorithm.

In an aspect of this disclosure, there is provided a novel image forming apparatus including an electrostatic latent image bearer; a charger to charge a surface of the electrostatic latent image bearer; a power source to output a charging bias supplied to the charger; an electrostatic latent image writing unit to write an electrostatic latent image on the surface of the electrostatic latent image bearer charged by the charger; a developing unit including a developing member to develop the electrostatic latent image to obtain a toner image; a developing power source to output a developing bias supplied to the developing unit; a processor to adjust the charging bias output from the power source to a predetermined target value, to adjust the developing bias output from the developing power source to a predetermined target value, and to conduct an adjustment process of adjusting a target value of the charging bias or adjusting a target value of the developing bias at a predetermined timing to stabilize image density; and a storage unit to store a predetermined common adjustment value. The predetermined common adjustment value is used as an adjustment value to decrease an amount of deviation of a background potential from an optimal background potential, due to output error with respect to the charging bias and output error with respect to the developing bias, by adjusting one of the target value of the charging bias adjusted in the adjustment process and the target value of the developing bias adjusted in the adjustment process in accordance with a combination thereof, the background potential being a potential difference between a surface of the developing member and a background portion of the electrostatic latent image bearer. The processor uniformly adjusts, irrespective of the combination of the target value of the charging bias adjusted in the adjustment process and the target value of the developing bias adjusted in the adjustment process, one of the target value of the charging bias adjusted in the adjustment process and the target value of the developing bias adjusted in the adjustment process with the predetermined common adjustment value.

These and other aspects, features, and advantages will be more fully apparent from the following detailed description of illustrative embodiments, the accompanying drawings, and associated claims.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
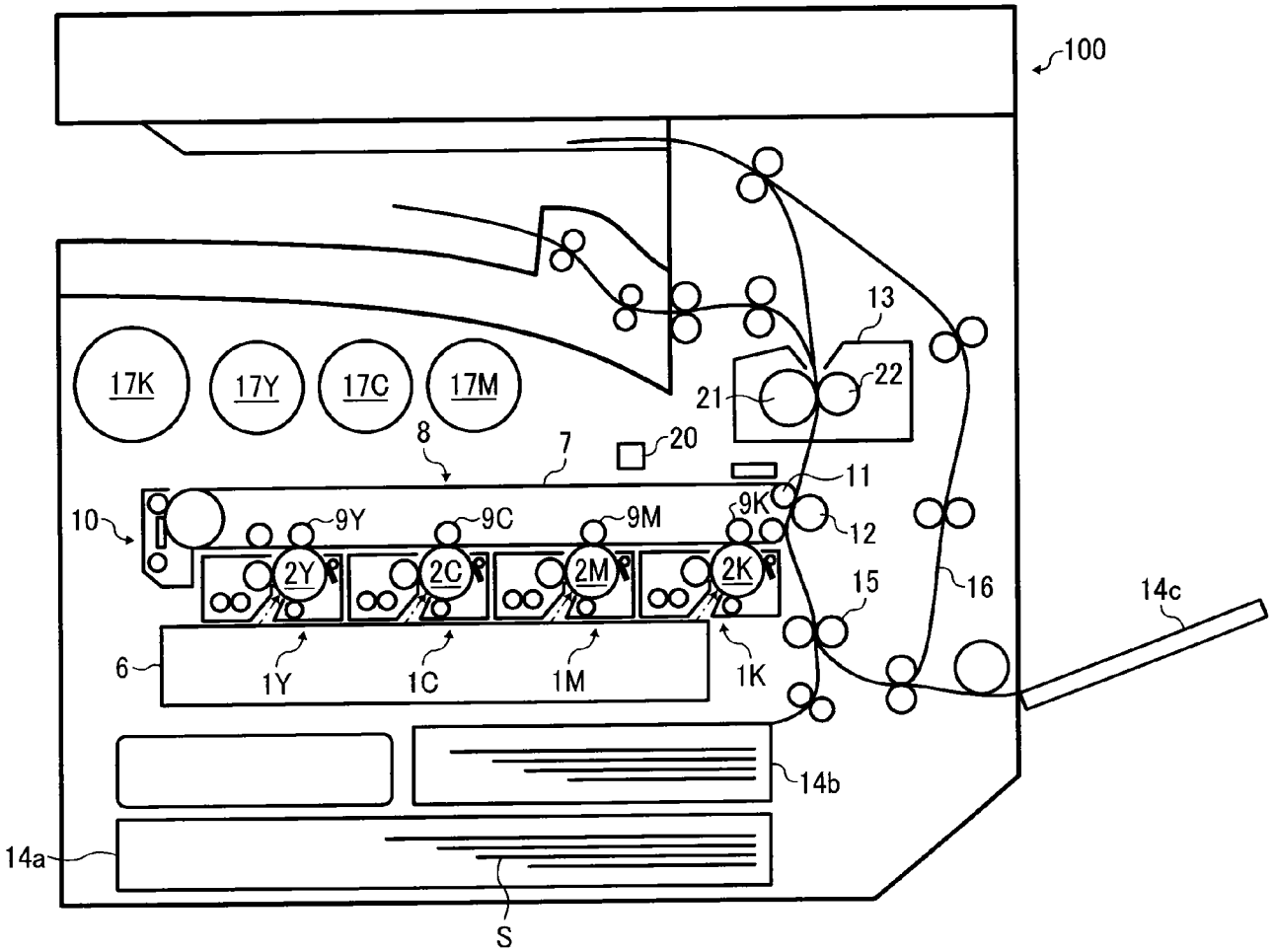
FIG. 1 is a schematic view of a configuration of a printer according to an embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

Hereinafter, exemplary embodiments of the present invention are described in detail with reference to the drawings. However, the present invention is not limited to the exemplary embodiments described below, but may be modified and improved within the scope of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

There is provided a first image forming apparatus as follows. A predetermined first algorithm and a predetermined second algorithm are stored in a nonvolatile memory of a controller of the first image forming apparatus. The first algorithm is an algorithm for determining an amount of deviation from a target value with respect to an actual charging bias output from a power source. The first algorithm is formed based on test results employing the power source provided in the first image forming apparatus. With the first algorithm, for example, in a case of trying to output a charging bias of −1500V from the power source, an amount of deviation from −1500V may be determined. The second algorithm is an algorithm for determining an amount of deviation from a target value with respect to an actual developing bias output from a developing power source. The second algorithm is formed based on test results employing the developing power source provided in the first image forming apparatus. With the second algorithm, for example, in a case of trying to output a developing bias of −700V from the developing power source, an amount of deviation from −700V may be determined. The controller adjusts the target value of the charging bias based on the amount of deviation determined with the first algorithm, and the actual charging bias output approaches the target value before adjustment. Accordingly, output error of the power source is suppressed. The controller also adjusts the target value of the developing bias based on the amount of deviation determined with the second algorithm, and the actual developing bias output approaches the target value before adjustment. Accordingly, output error of the developing power source is suppressed. By suppressing output error of the power source and the developing power source in the above-described manner, generation of background fogging or carrier adhesion caused by output error may be suppressed.

However, in the above-described first image forming apparatus, an increase in manufacturing cost may occur due to needing to input the first algorithm and the second algorithm in the nonvolatile memory of the controller by an operator at the time of shipment from a factory.

There is provided a novel image forming apparatus that suppresses generation of background fogging or carrier adhesion caused by output error, and suppresses increase in manufacturing cost. The image forming apparatus includes a controlling mechanism such as a controller or processor that adjusts an output of a charging bias from a power source to a predetermined target value, and adjusts an output of a developing bias from a developing power source to a predetermined target value.

The following is a description of an electrophotographic printer (hereinafter simply referred to as a printer) serving as an example of the image forming apparatus according to an embodiment of the present invention. Referring now to the drawings, a basic configuration of the printer according to an embodiment of the present invention is described in detail below.

FIG. 1 is a schematic view of a configuration of the printer 100 according to an embodiment of the present invention. As shown in FIG. 1, the printer 100 includes four image forming units 1Y, 1C, 1M, and 1K for forming color images of yellow, cyan, magenta, and black, respectively. In the following description, notation of Y, C, M, and K represent a member for yellow, a member for cyan, a member for magenta, and a member for black, respectively. It is to be noted that color sequence of Y, C, M, and K is not limited to the color sequence shown in FIG. 1 and different color sequences are possible.

Figure 2:
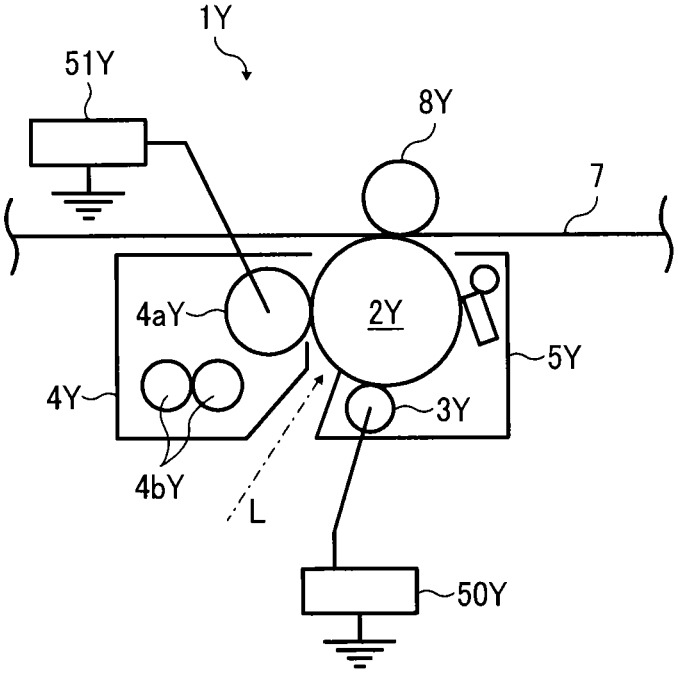
FIG. 2 is a schematic view of a configuration of an image forming unit of the printer according to an embodiment of the present invention.

FIG. 2 is a schematic view of a configuration of the image forming unit 1Y of the printer 100 according to an embodiment of the present invention. In the image forming unit 1Y shown in FIG. 2, a charging roller 3Y serving as a charger, a developing device 4Y serving as a developing unit, and a cleaning device 5Y are disposed around a drum-shaped photoreceptor 2Y serving as an electrostatic latent image bearer. The charging roller 3Y is formed of a rubber roller. The charging roller 3Y rotates while contacting a surface of the drum-shaped photoreceptor 2Y in a state in which a charging bias outputted from a power source 50Y is applied to the charging roller 3Y. In the printer 100, with respect to the above-described charging bias, a contacting direct current (DC) charging method that applies a DC bias without a superimposed alternating current (AC) component is employed. However, it is to be noted that other methods, such as a contacting AC charging roller method or a non-contacting charging roller method, may be employed with respect to the charging roller 3Y.

The developing device 4Y contains a two-component developer including yellow toner and magnetic carrier. An average particle diameter of the yellow toner ranges from 4.9 μm to 5.5 μm, and a bridge resistance of magnetic carrier having a small particle diameter and a low resistance is 12.1 Log Ω·cm or less.

The developing device 4Y includes a developing roller 4*a*Y serving as a developing member or a developer bearer provided opposite the photoreceptor 2Y, a screw 4*b*Y to agitate and convey the two-component developer, and a toner concentration sensor. The developing roller 4*a*Y is formed of a hollow sleeve serving as a developing sleeve that rotates, and a magnet roller. The magnet roller is provided inside the hollow sleeve in a manner so that the magnet roller does not rotate with the hollow sleeve. The developing sleeve of the developing roller 4*a*Y is supplied with a developing bias by a developing power source 51Y. Polarity of the developing bias is the same as charging polarity (in this example, the charging polarity is negative) of a background portion of the drum-shaped photoreceptor 2Y after uniform charging.

The image forming unit 1Y is a process cartridge including the drum-shaped photoreceptor 2Y with the charging roller 3Y, the developing device 4Y, and the cleaning device 5Y disposed around the drum-shaped photoreceptor 2Y supported as a single unit with a common supporting body. Accordingly, the image forming unit 1Y is detachably attachable with respect to a body of the printer 100, and consumable parts may be collectively replaced when operation life is reached.

The above-described configuration of the image forming unit 1Y applies to the image forming units 1C, 1M, and 1K with the exception of employing cyan toner in the image forming unit 1C, magenta toner in the image forming unit 1M, and black toner in the image forming unit 1K.

Provided below the image forming units 1Y, 1C, 1M, and 1K is an optical writing unit 6 serving as an electrostatic latent image writing unit. The optical writing unit 6 includes a light source, a polygon mirror, an f-θ lens, and a reflection mirror. Based upon an image data, a laser light L is optically scanned along a surface of the drum-shaped photoreceptor 2Y, a surface of a drum-shaped photoreceptor 2C, a surface of a drum-shaped photoreceptor 2M, and a surface of a drum-shaped photoreceptor 2K of each color. Accordingly, an electrostatic latent image for yellow, cyan, magenta, and black is formed on the drum-shaped photoreceptors 2Y, 2C, 2M, and 2K, respectively.

An intermediate transfer unit 8 is provided above the image forming units 1Y, 1C, 1M, and 1K. The intermediate transfer unit 8 transfers toner images of the respective colors developed from the electrostatic latent images of the respective colors on the drum-shaped photoreceptors 2Y, 2C, 2M, and 2K to a recording sheet S via an intermediate transfer belt 7. The endless intermediate transfer belt 7 is stretched around a plurality of rollers and is rotated in a counter clockwise direction by a rotational drive of at least one of the plurality of rollers. The intermediate transfer unit 8 includes, other than the intermediate transfer belt 7, primary transfer rollers 9Y, 9C, 9M, and 9K; a cleaning device 10 including a brush roller or a cleaning blade; a secondary transfer backup roller 11; and an optical sensor unit 20.

The primary transfer rollers 9Y, 9C, 9M, and 9K sandwich the intermediate transfer belt 7 with the drum-shaped photoreceptors 2Y, 2C, 2M, and 2K, respectively. Accordingly, primary transfer nips of the image forming units 1Y, 1C, 1M, and 1K are formed between the drum-shaped photoreceptors 2Y, 2C, 2M, and 2K and an outer surface of the intermediate transfer belt 7. The intermediate transfer unit 8 further includes a secondary transfer roller 12 provided adjacent to the secondary transfer backup roller 11 at an outer side of a belt loop of the intermediate transfer belt 7. The secondary transfer roller 12 sandwiches the intermediate transfer belt 7 with the secondary transfer backup roller 11, and forms a secondary transfer nip.

A fixing unit 13 is provided above the secondary transfer roller 12. The fixing unit 13 includes a fixing roller 21 and a pressure roller 22. Both the fixing roller 21 and the pressure roller 22 rotate and contact each other while rotating, and form a fixing nip at the contact between the fixing roller 21 and the pressure roller 22. More specifically, the fixing roller 21 includes a halogen heater. Electricity is supplied from a power source to the halogen heater so that a surface of the fixing roller 21 is heated to a predetermined temperature.

In a lower section of the body of the printer 100, a pair of registration rollers 15, a sheet feed roller, and sheet feed cassettes 14*a* and 14*b* are provided. The sheet feed cassettes 14*a* and 14*b* hold stacked recording sheets S serving as a recording medium to record an output image. In addition, at a side face of the body of the printer 100 according to an embodiment of the present invention, a manual feed tray 14*c* to manually feed recording sheets S from the side face is provided. As shown in FIG. 1, at the right of the intermediate transfer unit 8 and the fixing unit 13, a duplex unit 16 is provided to convey the recording sheet S to the secondary transfer nip once again when conducting duplex printing.

In a upper section of the body of the printer 100, toner replenishing containers 17Y, 17C, 17M, and 17K are provided to replenish toner of yellow, cyan, magenta, and black to the developing device 4Y, a developing device 4C, a developing device 4M, and a developing device 4K of the image forming units 1Y, 1C, 1M, and 1K, respectively. The body of the printer 100 also includes a waste toner bottle and a power source unit.

Next is a description of the action of the printer 100.

First, with respect to the image forming unit 1Y, the charging bias is applied to the charging roller 3Y by the power source 50Y. Accordingly, the surface of the drum-shaped photoreceptor 2Y that rotates and contacts the charging roller 3Y is uniformly charged. It is to be noted that in the printer 100, the charging bias applied to the charging roller 3Y has negative polarity and the surface of the drum-shaped photoreceptor 2Y is charged to negative polarity. With respect to the charged surface of the drum-shaped photoreceptor 2Y, the optical writing unit 6 conducts scanning with the laser light L based upon an image data. Accordingly, a potential of an area of the charged surface of the drum-shaped photoreceptor 2Y irradiated by the laser light L attenuates and the electrostatic latent image is formed. When the surface of the drum-shaped photoreceptor 2Y having the electrostatic latent image rotates and reaches the developing device 4Y, yellow toner is supplied to the electrostatic latent image on the surface of the drum-shaped photoreceptor 2Y by the developing roller 4*a*Y provided opposite the drum-shaped photoreceptor 2Y. Accordingly, a yellow toner image is formed on the surface of the drum-shaped photoreceptor 2Y. It is to be noted that in the developing device 4Y, an appropriate amount of yellow toner is replenished from the toner supplying container 17Y according to an output of the toner concentration sensor.

The above-described action of the image forming unit 1Y also applies to the image forming units 1C, 1M, and 1K at a predetermined timing. Accordingly, the yellow toner image, a cyan toner image, a magenta toner image, and a black toner image are formed on the surfaces of the drum-shaped photoreceptors 2Y, 2C, 2M, and 2K, respectively. The yellow toner image, the cyan toner image, the magenta toner image, and the black toner image are sequentially superimposed over each other on the outer surface of the intermediate transfer belt 7 in a primary transfer at each of the primary transfer nips of the image forming units 1Y, 1C, 1M, and 1K. The primary transfer at each of the primary transfer nips is conducted by applying a voltage to the primary transfer rollers 9Y, 9C, 9M, and 9K with a transfer power source. Polarity of the voltage is opposite (in this example of printer 100, polarity is positive) to charging polarity of toner (in this example of printer 100, polarity is negative).

A recording sheet S is conveyed from the sheet feed cassettes 14*a* and 14*b* or the manual feed tray 14*c*, and temporarily stops at the pair of registration rollers 15. The pair of registration rollers 15 rotates at a predetermined timing and conveys the recording sheet S towards the secondary transfer nip.

A composite toner image of four colors formed by the above-described sequential superimposing of the yellow toner image, the cyan toner image, the magenta toner image, and the black toner image over each other on the surface of the intermediate transfer belt 7 is transferred, in a secondary transfer, to the recording sheet S at the secondary transfer nip formed at the contact between the secondary transfer roller 12 and the intermediate transfer belt 7. The secondary transfer is conducted by applying a voltage having opposite polarity to charging polarity of toner to the secondary transfer roller 12 with a secondary transfer power source. The recording sheet S having the composite toner image of four colors is conveyed towards the fixing unit 13 after exiting the secondary transfer nip, and is sandwiched by the fixing nip. The composite toner image of four colors on the recording sheet S is fixed to the recording sheet S by heat from the fixing roller 21 at the fixing nip. In a case of single-side printing, the recording sheet S with the fixed composite toner image of four colors is ejected from the printer 100 with conveying rollers. In a case of duplex printing, the recording sheet S is conveyed by conveying rollers to the duplex unit 16. The recording sheet S with the fixed composite toner image of four colors is turned over and another image is formed on the opposite side of the recording sheet S with the above-described action. Then, the recording sheet S is ejected from the printer 100 with conveying rollers.

In the printer 100 according to an embodiment of the present invention, a control called a process control is conducted at a predetermined timing to stabilize image quality (e.g., image density) over time or with respect to environmental fluctuation. In the process control that serves as an adjustment process, the following actions are conducted. A Y patch-pattern toner image formed of a plurality of Y patch-pattern images is formed on the drum-shaped photoreceptor 2Y by developing, and then transferred to the surface of the intermediate transfer belt 7. A C patch-pattern toner image formed of a plurality of C patch-pattern images is formed on the drum-shaped photoreceptor 2C by developing, and then transferred to the surface of the intermediate transfer belt 7. An M patch-pattern toner image formed of a plurality of M patch-pattern images is formed on the drum-shaped photoreceptor 2M by developing, and then transferred to the surface of the intermediate transfer belt 7. A K patch-pattern toner image formed of a plurality of K patch-pattern images is formed on the drum-shaped photoreceptor 2K by developing, and then transferred to the surface of the intermediate transfer belt 7. Then, at the optical sensor unit 20, an amount of adherence of yellow toner in the Y patch-pattern toner image, cyan toner in the C patch-pattern toner image, magenta toner in the M patch-pattern toner image, and black toner in the K patch-pattern toner image, respectively, is detected. According to detection results, image formation conditions such as a developing bias Vb are adjusted.

Figure 3:
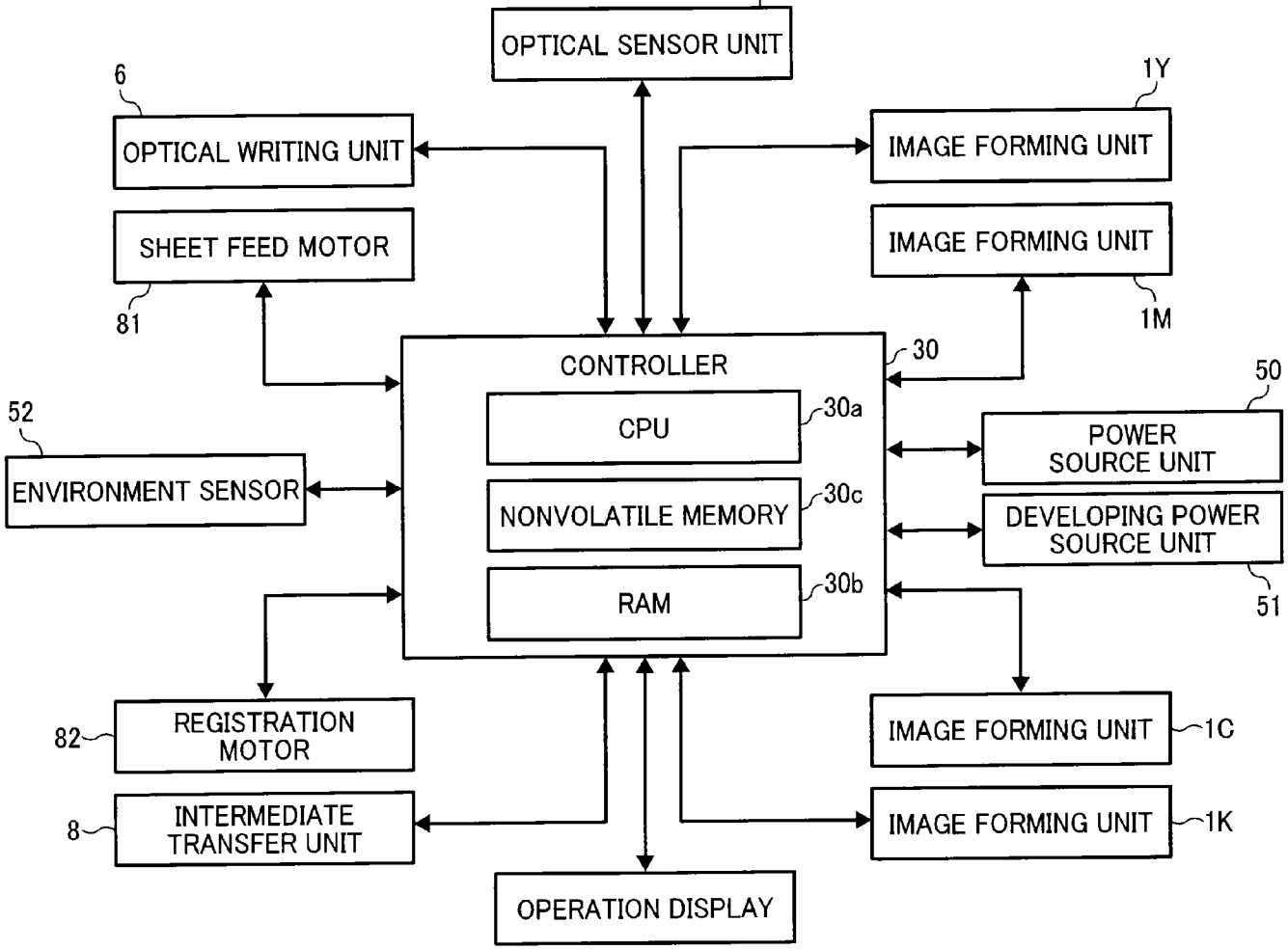
FIG. 3 is a block diagram illustrating principal parts of an electrical circuit of the printer according to an embodiment of the present invention.
Figure 4:
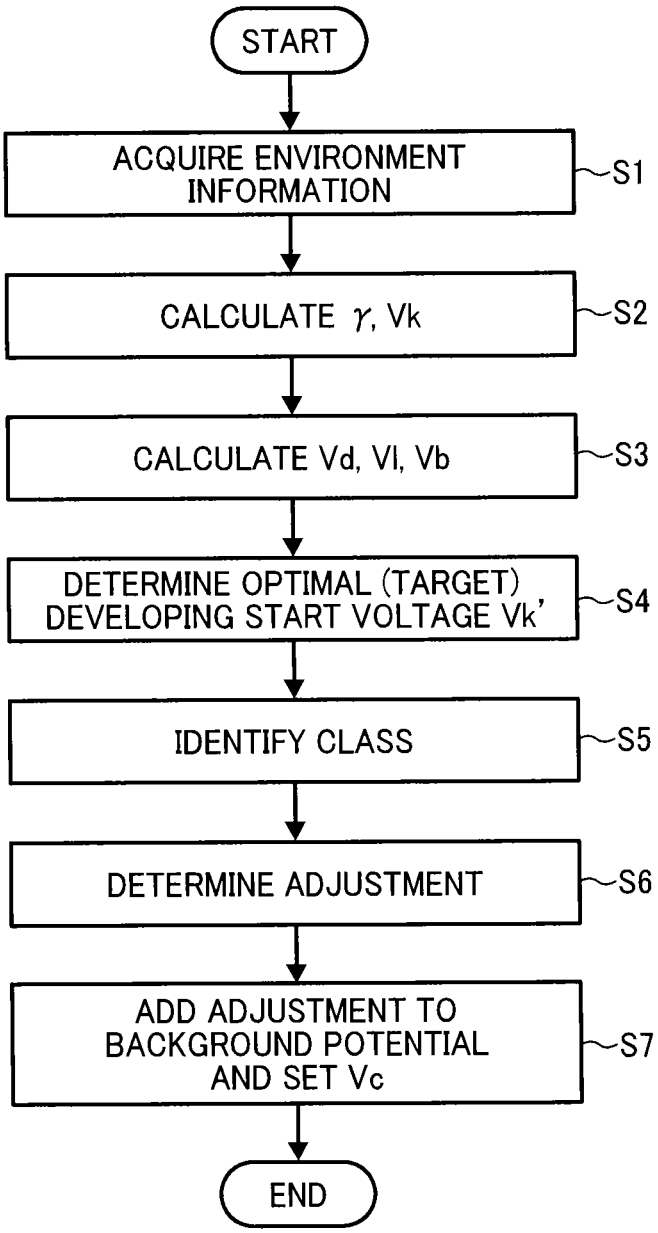
FIG. 4 is a flow chart illustrating computing processes of a process control.

The following is a description of the process control. FIG. 3 is a block diagram illustrating principal parts of an electrical circuit of the printer 100 according to an embodiment of the present invention. FIG. 4 is a flow chart illustrating computing processes of the process control. As shown in FIG. 3, a controller 30 serving as the controlling mechanism or processor is electrically connected to, for example, the image forming units 1Y, 1C, 1M, and 1K, the optical writing unit 6, a sheet feed motor 81, a registration motor 82, the intermediate transfer unit 8, and the optical sensor unit 20. The controller 30 includes a CPU 30*a* in which computing processes and various programs are run, and a RAM 30*b* to store data. The sheet feed motor 81 is a driving source of the sheet feed roller of the sheet feed cassettes 14*a* and 14*b* and the manual feed tray 14*c*. The registration motor 82 is a driving source of the pair of registration rollers 15. A power source unit 50 that is connected to the controller 30 includes the power sources 50Y, 50C, 50M, and 50K for the image forming units 1Y, 1C, 1M, and 1K. A developing power source unit 51 that is connected to the controller 30 includes the developing power sources 51Y, 51C, 51M, and 51K for the image forming units 1Y, 1C, 1M, and 1K.

Figure 5:
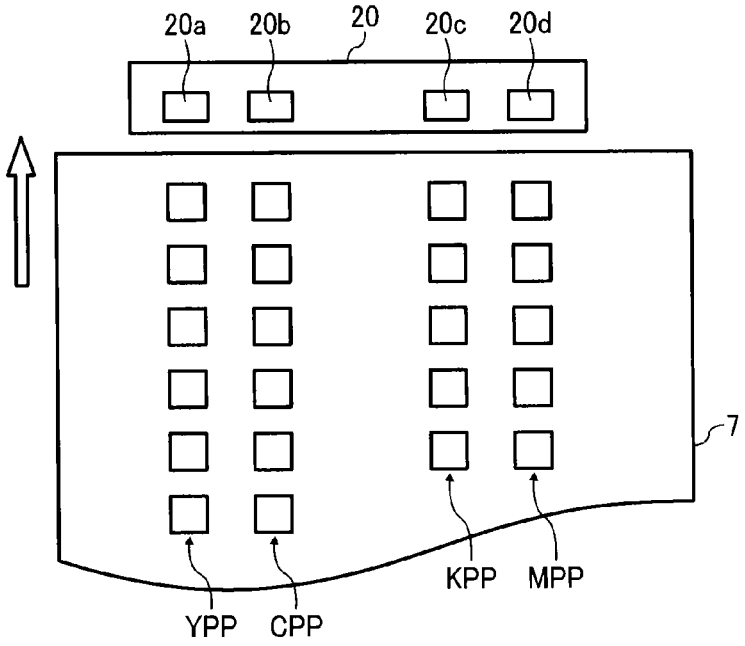
FIG. 5 is a schematic view of an example of a patch-pattern toner image on a surface of an intermediate transfer belt.

The optical sensor unit 20 includes a plurality of reflection-type photo sensors provided in a line across the width of the intermediate transfer belt 7 at predetermined intervals as shown in FIG. 5. In the present embodiment, four reflection-type photo sensors are provided in the optical sensor unit 20. Each of the reflection-type photo sensors is configured to output a signal according to a light reflection rate of the Y patch-pattern toner image on the surface of the intermediate transfer belt 7, a light reflection rate of the C patch-pattern toner image on the surface of the intermediate transfer belt 7, a light reflection rate of the M patch-pattern toner image on the surface of the intermediate transfer belt 7, and a light reflection rate of the K patch-pattern toner image on the surface of the intermediate transfer belt 7, respectively; or output a signal according to a light reflection rate of the intermediate transfer belt 7.

More specifically, of the above-described four reflection-type photo sensors, three of the reflection-type photo sensors that are for Y, C, and M capture both specular reflection light and diffuse reflection light at the surface of the intermediate transfer belt 7. Each of the three reflection-type photo sensors for Y, C, and M outputs a signal according to an amount of specular reflection light and diffuse reflection light they receive. With the three reflection-type photo sensors for Y, C, and M, output of signals according to the Y patch-pattern toner image, the C patch-pattern toner image, and the M patch-pattern toner image or output of signals according to an amount of adherence of yellow toner, cyan toner, and magenta toner are obtained. The remaining reflection-type photo sensor that is for K captures specular reflection light at the surface of the intermediate transfer belt 7 and outputs a signal according to an amount of light of specular reflection light. With the remaining reflection-type photo sensor applied for K, output of a signal according to the K patch-pattern toner image or output of a signal according to an amount of adherence of black toner is obtained.

The controller 30 conducts the process control at a predetermined timing such as at a standby after a predetermined number of printouts, after the passage of a predetermined period of time, or when the power is turned on. More specifically, as indicated in step S1 of FIG. 4, when the predetermined timing is reached, environment information such as number of recording sheets S passed through, image ratio, temperature, and humidity is acquired.

Next, developing characteristics of each of the image forming units 1Y, 1C, 1M, and 1K are acquired. More specifically, as indicated in step S2 of FIG. 4, for each color of yellow, cyan, magenta, and black, a developing gamma y and a developing start voltage Vk are calculated as follows: Each of the drum-shaped photoreceptors 2Y, 2C, 2M, and 2K is uniformly charged while rotating. It is to be noted that with respect to the above-described uniform charging of the drum-shaped photoreceptors 2Y, 2C, 2M, and 2K, an absolute value of a charging bias Vc is increased. This increase is different from normal printing. In normal printing, a uniform value such as −700V is employed. The optical writing unit 6 renders the electrostatic latent images of the Y patch-pattern toner image, the C patch-pattern toner image, the M patch-pattern toner image, and the K patch-pattern toner image visible by scanning the laser light L on the drum-shaped photoreceptors 2Y, 2C, 2M, and 2K, respectively. The electrostatic latent images are developed with the developing devices 4Y, 4C, 4M, and 4K. Accordingly, the Y patch-pattern toner image, the C patch-pattern toner image, the M patch-pattern toner image, and the K patch-pattern toner image are formed on the drum-shaped photoreceptors 2Y, 2C, 2M, and 2K, respectively. It is to be noted that with respect to the above-described developing of the electrostatic latent images, the controller 30 also gradually increases an absolute value of a developing bias Vb applied to the developing roller 4*a*Y, a developing roller 4*a*C, a developing roller 4*a*M, and a developing roller 4*a*K of each color. Both the developing bias Vb and the charging bias Vc are negative polarity DC biases.

The Y patch-pattern toner image, the C patch-pattern toner image, the M patch-pattern toner image, and the K patch-pattern toner image are then transferred to the surface of the intermediate transfer belt 7. FIG. 5 is a schematic view of an example of a Y patch-pattern toner image YPP, a C patch-pattern toner image CPP, an M patch-pattern toner image MPP, and a K patch-pattern toner image KPP on the surface of the intermediate transfer belt 7. As shown in FIG. 5, the Y patch-pattern toner image YPP, the C patch-pattern toner image CPP, the M patch-pattern toner image MPP, and the K patch-pattern toner image KPP are transferred to the surface of the intermediate transfer belt 7 in a line across the width of the surface of the intermediate transfer belt 7, and do not overlap each other. More specifically, the Y patch-pattern toner image YPP is transferred to one end portion of the surface of the intermediate transfer belt 7 in the width direction. The C patch-pattern toner image CPP is transferred to a position slightly offset from the Y patch-pattern toner image YPP at a center side of the surface of the intermediate transfer belt 7 in the width direction. The M patch-pattern toner image MPP is transferred to the other end portion of the surface of the intermediate transfer belt 7 in the width direction. The K patch-pattern toner image KPP is transferred to a position slightly offset from the M patch-pattern toner image MPP at a center side of the surface of the intermediate transfer belt 7 in the width direction.

The optical sensor unit 20 includes a first reflection-type photo sensor 20*a*, a second reflection-type photo sensor 20*b*, a third reflection-type photo sensor 20*c*, and a fourth reflection-type photo sensor 20*d*. Each of the first reflection-type photo sensor 20*a*, the second reflection-type photo sensor 20*b*, the third reflection-type photo sensor 20*c*, and the fourth reflection-type photo sensor 20*d* detect light reflection characteristics of the surface of the intermediate transfer belt 7 at each differing individual positions across the width of the surface of the intermediate transfer belt 7. More specifically, of the above-described four reflection-type photo sensors 20*a*, 20*b*, 20*c*, and 20*d*, the third reflection-type photo sensor 20*c* detects specular reflection light, and detects change to light reflection characteristics of the surface of the intermediate transfer belt 7 caused by adherence of black toner. By contrast, the other three reflection-type photo sensors 20*a*, 20*b*, and 20*d* detect both specular reflection light and diffuse reflection light. The three reflection-type photo sensors 20*a*, 20*b*, and 20*d* detect change to light reflection characteristics of the surface of the intermediate transfer belt 7 caused by adherence of yellow toner, cyan toner, and magenta toner, respectively.

The first reflection-type photo sensor 20*a* is provided at a position to detect an amount of adherence of yellow toner in the Y patch-pattern toner image YPP formed at one end portion of the surface of the intermediate transfer belt 7 in the width direction. The second reflection-type photo sensor 20*b* is provided at a position to detect an amount of adherence of cyan toner in the C patch-pattern toner image CPP formed at the position slightly offset from the Y patch-pattern toner image YPP at the center side of the surface of the intermediate transfer belt 7 in the width direction. The fourth reflection-type photo sensor 20*d* is provided at a position to detect an amount of adherence of magenta toner in the M patch-pattern toner image MPP formed at the other end portion of the surface of the intermediate transfer belt 7 in the width direction. The third reflection-type photo sensor 20*c* is provided at a position to detect an amount of adherence of black toner in the K patch-pattern toner image KPP formed at the position slightly offset from the M patch-pattern toner image MPP at the center side of the surface of the intermediate transfer belt 7 in the width direction.

The controller 30 calculates light reflection rates of the Y patch-pattern toner image YPP, the C patch-pattern toner image CPP, the M patch-pattern toner image MPP, and the K patch-pattern toner image KPP based on outputted signals sequentially sent from the four reflection-type photo sensors 20*a*, 20*b*, 20*c*, and 20*d* of the optical sensor unit 20. Then, based on the calculation results from the light reflection rates, the amount of adherence of yellow toner in the Y patch-pattern toner image YPP, cyan toner in the C patch-pattern toner image CPP, magenta toner in the M patch-pattern toner image MPP, and black toner in the K patch-pattern toner image KPP are determined and stored in RAM 30*b*. It is to be noted that the Y patch-pattern toner image YPP, the C patch-pattern toner image CPP, the M patch-pattern toner image MPP, and the K patch-pattern toner image KPP on the surface of the intermediate transfer belt 7 that are conveyed with the traveling of the intermediate transfer belt 7 are removed from the surface of the intermediate transfer belt 7 by the cleaning device 10 after passing a position opposite the optical sensor unit 20.

Figure 6:
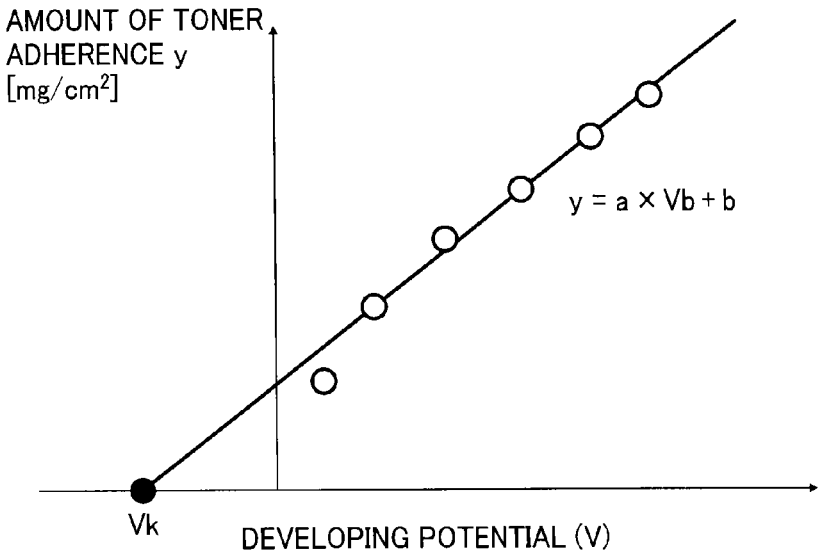
FIG. 6 is a graph showing a relation between a developing potential and an amount of toner adherence.

Based on image density data (i.e., amount of adherence of each color toner) stored in the RAM 30*b* and an exposed portion potential data (i.e., potential of electrostatic latent images on the drum-shaped photoreceptors 2Y, 2C, 2M, and 2K) separately stored in the RAM 30*b*, a straight-line approximation formula y=axVb+b is calculated as shown in FIG. 6. FIG. 6 is a graph showing a relation between a developing potential and an amount of toner adherence of one of the above-described patch-pattern toner images. The X axis represents the developing potential Vl−Vb, more specifically, a value in which an applied developing bias Vb is subtracted from an exposed portion potential Vl. The Y axis represents an amount of toner adherence (y) per unit area. In FIG. 6, the number of data points that are plotted in the X-Y field correspond to number of patch-patterns in one of the above-described patch-pattern toner images. Based on plotted data, a section in the X-Y field is determined for conducting straight-line approximation. With respect to the determined section, a method of least squares is applied. Accordingly, the straight-line approximation formula y=axVb+b is obtained. Based on the straight-line approximation formula, the developing gamma y and the developing start voltage Vk are calculated. The developing gamma y is slope (y=a) of the straight-line approximation formula, and the developing start voltage Vk is a cross point (Vk=−b/a) of the straight-line approximation formula and X axis. In the above-described manner, as indicated in step S2 of FIG. 4, developing characteristics of each of the image forming units 1Y, 1C, 1M, and 1K of each color are calculated.

Next, as indicated in step S3 of FIG. 4, a target value of a charging potential Vd (i.e., a potential of a background portion of a photoreceptor), a target value of the exposed portion potential Vl, and a developing bias Vb are determined for each of the image forming units 1Y, 1C, 1M, and 1K based on the acquired developing characteristics of each of the image forming units 1Y, 1C, 1M, and 1K.

The following is a description with respect to one of the image forming units 1Y, 1C, 1M, and 1K, more specifically, the image forming unit 1Y. The target charging potential and the target exposed portion potential are determined based on a predetermined table defining relationship of the developing gamma y, the charging potential Vd, and the exposed portion potential Vl. Thus, the target charging potential and the target exposed portion potential appropriate to the developing gamma y may be selected. The developing bias Vb is determined as follows. A developing potential that obtains a maximum amount of toner adherence is determined from the combination of the developing gamma y and the developing start voltage Vk. Then, the developing bias Vb is determined so that the developing potential obtaining the maximum amount of toner adherence is obtained.

Next, based on the determined developing bias Vb and a background potential, the target charging potential is determined. A surface of the developing sleeve of the developing roller 4*a*Y obtains a value approximately the same as the developing bias Vb. If the surface of the drum-shaped photoreceptor 2Y is charged to the target charging potential and appropriate exposure is conducted, the optimal developing potential or an optimal background potential is obtained.

Then, the controller 30 determines a charging bias Vc. The charging bias Vc that obtains the target charging potential changes according to amount of wear of a surface layer of the drum-shaped photoreceptor 2Y or electric resistance of the charging roller 3Y influenced by environment. To respond to the above-described change, the controller 30 stores a charging algorithm to determine, from a combination of environment (e.g., temperature and humidity) and running distance of the drum-shaped photoreceptor 2Y, the charging bias Vc that obtains the target charging potential. The charging algorithm is formed based on prior experiments. Thus, with the charging algorithm and from the combination of running distance of the drum-shaped photoreceptor 2Y stored in the RAM 30*b* and detection results of temperature and humidity detected by an environment sensor 52, the charging bias Vc is determined so that the target charging potential is obtained.

Regarding characteristics of the two-component developer, background fogging gets worse over time whereas carrier adhesion (e.g., carrier adhesion to edges) is worse initially. Thus, the appropriate background potential shifts toward a larger value in accordance with use of the two-component developer. In addition, generally, in a high temperature and a high humidity environment, background fogging gets worse due to low toner charge. In a low temperature and a low humidity environment, carrier adhesion is worse. Thus, in an image density control of an embodiment of the present invention, the background potential is shifted to an appropriate value according to initial stage/passage of time and environment.

The appropriate background potential for each condition is predetermined from experiments to keep background fogging or carrier adhesion at or below an optimal target. Thus, adjustment to some extent is possible if environment information is available such as degradation of charging rollers, degradation of carriers, and change to temperature and humidity. However, there is a possibility that the appropriate background potential may change due to an unexpected factor or a difference with respect to experiments.

Additionally, it is to be noted that the following is a description with respect to one of the image forming units 1Y, 1C, 1M, and 1K, more specifically, the image forming unit 1Y. The developing start voltage Vk may be considered to be a voltage at which developing is started with respect to the drum-shaped photoreceptor 2Y. If the background potential is not equal to or more to an absolute value of the developing start voltage Vk, background fogging gets worse.

Thus, as indicated in step S4 of FIG. 4, an optimal developing start voltage Vk' is determined after step S3. In prior conducted experiments, the optimal developing start voltage Vk' is associated with environment information, and organized in a table. Accordingly, the controller 30 determines the optimal developing start voltage Vk' by referencing the table with acquired initial environment information. Then, as indicated in step S5 of FIG. 4, classification is conducted. Class is divided by difference of amount between the developing start voltage Vk and the optimal developing start voltage Vk'. For example, the developing start voltage Vk having a difference of +40V or more with respect to the optimal developing start voltage Vk' is defined as class 1, the developing start voltage Vk having a difference of less than +40V to +20V or more with respect to the optimal developing start voltage Vk' is defined as class 2, and the developing start voltage Vk having a difference of less than +20V to 0V or more with respect to the optimal developing start voltage Vk' is defined as class 3. Identification of which class the developing start voltage Vk belongs to is conducted. Then, as indicated in step S6 of FIG. 4, and an amount of adjustment is determined for each class.

Next, the amount of adjustment determined in step S6 is added to the background potential calculated from the charging potential Vd and the developing bias Vb determined in step S3, and a target background potential is calculated. Then, as indicated in step S7 of FIG. 4, the charging bias Vc is determined so that the target background potential is obtained.

With the above-described process control, the controller 30 sets a value of the charging bias Vc or a value of the developing bias Vb for each color of yellow, cyan, magenta, and black. In a print job, a primary control signal is outputted by the controller 30 for each of the power sources 50Y, 50C, 50M, and 50K to make each of the power sources 50Y, 50C, 50M, and 50K output individually set charging biases Vc. To output the above-described primary control signal, a nonvolatile memory 30*c* stores a primary control signal data table defining a relation between a primary control signal value and a setting value of the charging bias Vc. For example, in a case of trying to output a charging bias Vc of −1500V from the power source 50Y, a primary control signal value corresponding to −1500V is determined based on the primary control signal data table, and the determined primary control signal value is outputted to the power source 50Y.

In addition, in the print job, a secondary control signal is outputted by the controller 30 with respect to each of the developing power sources 51Y, 51C, 51M, and 51K to make each of the developing power sources 51Y, 51C, 51M, and 51K output individually set developing biases Vb. To output the above-described secondary control signal, the nonvolatile memory 30*c* stores a secondary control signal data table defining a relation between a secondary control signal value and a setting value of the developing bias Vb. For example, in a case of trying to output a developing bias Vb of −700V from the developing power source 51Y, a secondary control signal value corresponding to −700V is determined based on the secondary control signal data table, and the determined secondary control signal value is outputted to the developing power source 51Y.

Figure 7:
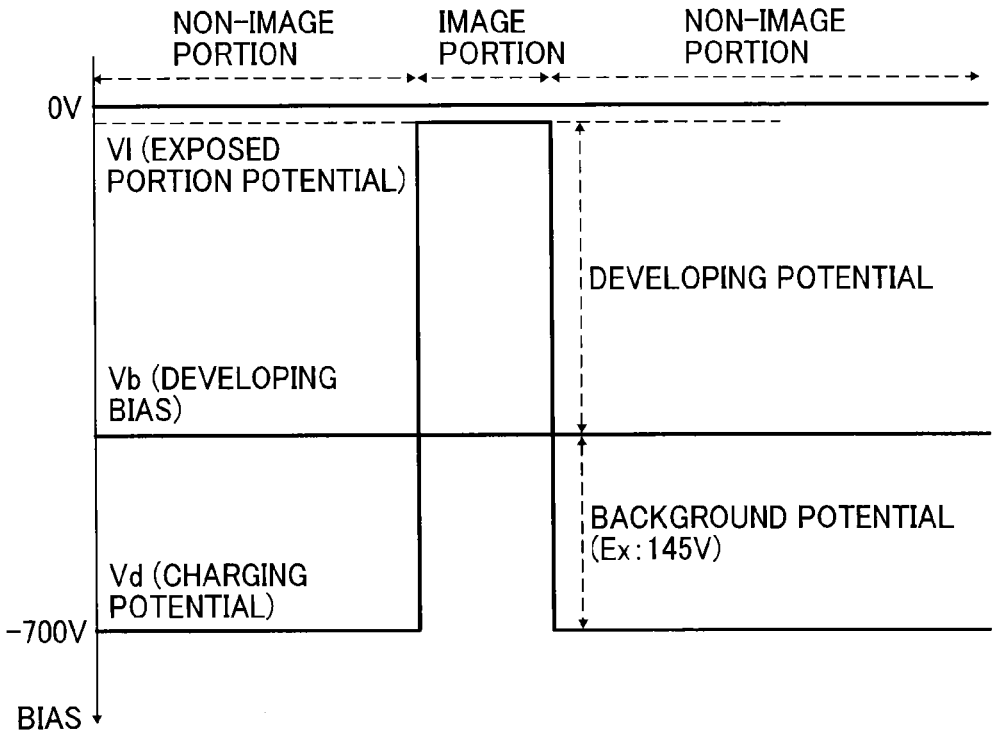
FIG. 7 is a graph describing the developing potential or a background potential.

FIG. 7 is a graph describing a developing potential or a background potential. As shown in FIG. 7, the background potential is a difference between a charging potential Vd and a developing bias Vb, and acts upon a non-image portion (i.e., background portion) of an image. When the background potential is small, background fogging is easily generated. When the background potential is large, carrier adhesion is easily generated. Thus, there is a need to set the background potential to an appropriate value.

Figure 8:
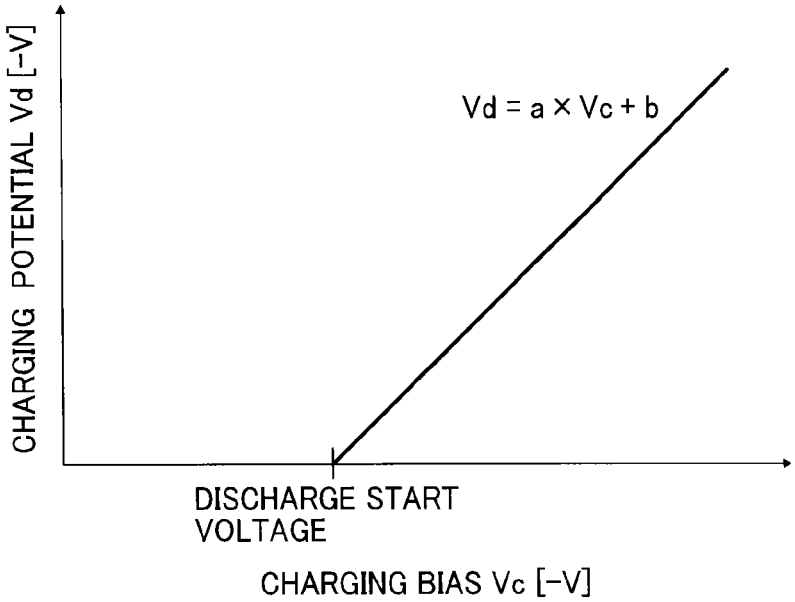
FIG. 8 is a graph showing a relation between a charging potential and a charging bias.

FIG. 8 is a graph showing a relation between a charging potential Vd and a charging bias Vc. As described above in an embodiment according to the present invention, a charging roller (e.g., the charging roller 3Y) formed of a rubber roller is supplied with the charging bias Vc. Accordingly, the charging potential Vd of a photoreceptor (e.g., the drum-shaped photoreceptor 2Y) is represented by formula Vd=axVc+b shown in FIG. 8. With respect to the formula shown in FIG. 8, a represents the slope of the graph, b represents a charging potential Vd axis segment, and value of the formula is a minus value. A charging bias Vc axis segment has a value approximately the same as a discharge start voltage between the charging roller and the photoreceptor. The slope a is approximately 1.

The following is a description of features of the printer 100 according to an embodiment of the present invention. It is to be noted that the following is also a description with respect to the image forming unit 1Y and the description applies to the other the image forming units 1C, 1M, and 1K.

As described above, in the printer 100, the contacting DC charging method that applies the charging bias Vc formed of a DC component is employed with respect to the charging roller 3Y contacting the drum-shaped photoreceptor 2Y. Unlike a method employing an AC/DC superimposed bias as the charging bias Vc, the contacting DC charging method does not need an AC power source and cost reduction is obtained. On the other hand, due to not forming an alternating electric field between the charging roller 3Y and the drum-shaped photoreceptor 2Y, a value of the charging bias Vc has to be made larger than the discharge start voltage shown in FIG. 8. If the value of the charging bias Vc is not made larger than the discharge start voltage, discharge between the charging roller 3Y and the drum-shaped photoreceptor 2Y is not generated and charging of the drum-shaped photoreceptor 2Y is not obtained. In addition, even if charging is obtained, if there is an output error by the power sources 50Y, 50C, 50M, and 50K or the developing power sources 51Y, 51C, 51M, and 51K, an target value of the charging potential Vd is off.

Figure 9:
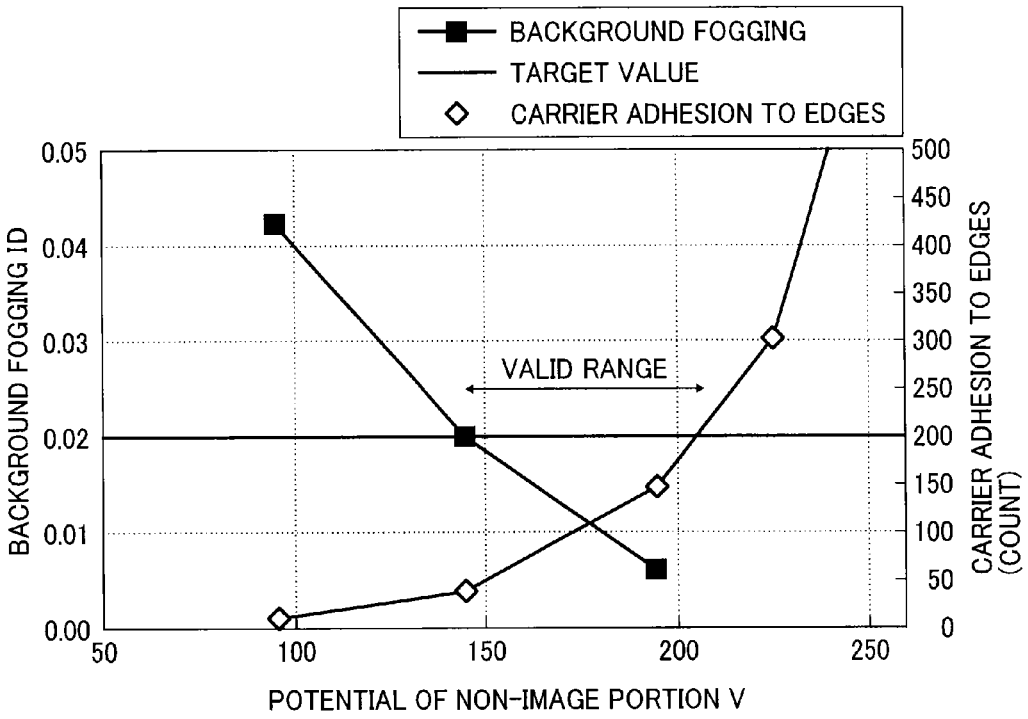
FIG. 9 is a graph showing a relation between background fogging, the background potential, and carrier adhesion to edges.

FIG. 9 is a graph showing a relation between background fogging ID, background potential, and carrier adhesion to edges (i.e., carrier adhesion amount with respect to a photoreceptor). The background fogging ID is a measure of image density of toner on an adhesive tape transferred from a background portion of a photoreceptor. Carrier adhesion to edges is, more specifically, a count of magnetic carrier, when outputting an image with many emphasized edge portions, adhering around the edges of the image on a photoreceptor. As shown in FIG. 9, when the background potential declines, the background fogging ID increases. When the background potential increases, the carrier adhesion to edges increases. In the example shown in FIG. 9, it can be seen that the optimum or appropriate value of the background potential is approximately 180V. Thus, the background potential should be within ±30V of the appropriate value of approximately 180V. If it is not within ±30V, background fogging or carrier adhesion is generated. The appropriate value differs according to machine type. However, if the type of machine is the same, there is no large variation in the appropriate value. Normally, as long as a developing bias Vb or a charging bias Vc set with a process control is outputted, background fogging or carrier adhesion is not easily generated. However, if the developing bias Vb or the charging bias Vc differs from the set value of the process control due to output error of a developing power source or a power source, the background potential may differ from the optimal background potential on a large scale, and background fogging or carrier adhesion may be generated.

Thus, the controller 30 conducts a target value adjustment process in which a target value (i.e., setting value) of the charging bias Vc of each of the image forming units 1Y, 1C, 1M, and 1K determined by the process control is adjusted to make the actual charging bias Vc output closer to the target value.

The following is a detailed description of the above-described target value adjustment process. It is to be noted that the following is also a description with respect to the image forming unit 1Y and the description applies to the other the image forming units 1C, 1M, and 1K.

It is to be noted that in the printer 100, as shown in FIG. 8, the charging bias Vc has negative polarity and charges the drum-shaped photoreceptor 2Y to negative polarity. In addition, an absolute value of the charging potential Vd may be made larger by making an absolute value of the charging bias Vc larger. It is to be also noted that in the printer 100, as shown in FIG. 7, the developing bias Vb has negative polarity and an absolute value of the developing bias Vb is smaller than an absolute value of the charging potential Vd. By making the surface of the developing sleeve have a potential approximately the same as the developing bias Vb and forming an electric field between the surface of the developing sleeve and the background portion of the drum-shaped photoreceptor 2Y that electrostatically moves the negative polarity toner from the developing sleeve side to the background portion side of the drum-shaped photoreceptor 2Y, the negative polarity toner is prevented from adhering to the background portion of the drum-shaped photoreceptor 2Y.

If the background potential that is the potential difference between the charging potential Vd and the developing bias Vb is smaller than an optimal target, as described above, background fogging is easily generated. When an absolute value of the charging potential Vd having negative polarity becomes small, the background potential becomes small. When an absolute value of the developing bias Vb having negative polarity becomes large, the background potential becomes small.

On the other hand, if the background potential is larger than an optimal target, as described above, carrier adhesion is easily generated. When an absolute value of the charging potential Vd having negative polarity becomes large, the background potential becomes large. When an absolute value of the developing bias Vb having negative polarity becomes small, the background potential becomes large.

In the printer 100, the charging bias Vc outputted from each of the power sources 50Y, 50C, 50M, and 50K is adjustable in a range from approximately −1100V to approximately −1550V, and output error is within approximately +−3%. In addition, the developing bias Vb outputted from each of the developing power sources 51Y, 51C, 51M, and 51K is adjustable in a range from approximately −350V to approximately −700V, and output error is within approximately +−3%. With the above-described configuration, there is a possibility of an output error of +−47V with respect to the charging bias Vc and a possibility of an output error of +−21 V with respect to the developing bias Vb. Accordingly, with respect to the background potential, there is a possibility of deviation from an optimal target by +−68V at maximum. The above-described deviation, or more specifically, amount of deviation, is sufficient to generate background fogging or carrier adhesion. In other words, there is a possibility of generating background fogging or carrier adhesion due to output error of the power sources 50Y, 50C, 50M, and 50K or output error of the developing power sources 51Y, 51C, 51M, and 51K.

Figure 10:
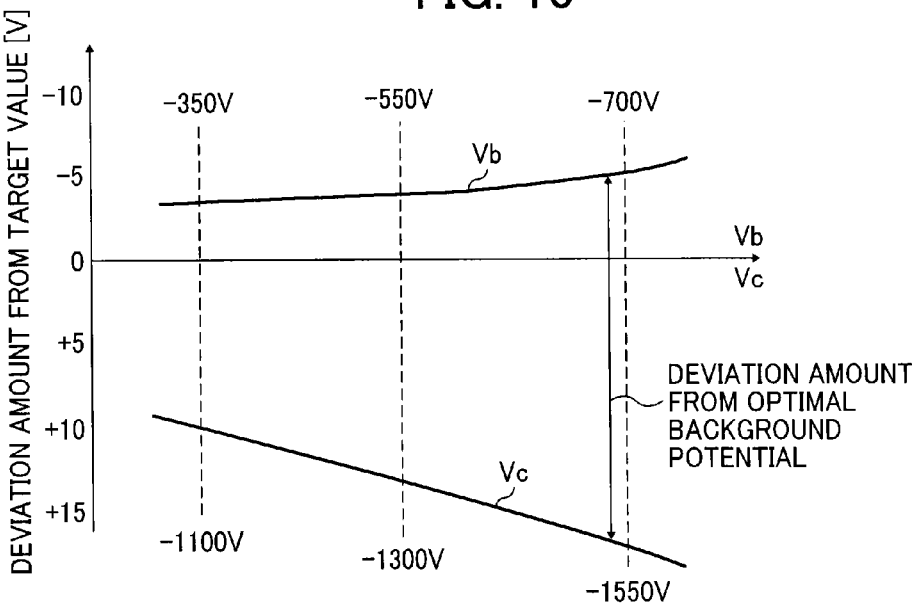
FIG. 10 is a graph showing an example of a relation between an output characteristic of a power source outputting the charging bias, an output characteristic of a developing power source outputting a developing bias, an amount of deviation of the charging bias from a target value, and an amount of deviation of the developing bias from a target value.

FIG. 10 is a graph showing an example of a relation between an output characteristic of the power source 50Y outputting a charging bias Vc, an output characteristic of the developing power source 51Y outputting a developing bias Vb, an amount of deviation of the charging bias Vc from a target value, and an amount of deviation of the developing bias Vb from a target value. In the example, the power source 50Y has the output characteristic of shifting the charging bias Vc towards a positive polarity side further than a target value of the charging bias Vc irrespective of the target value of the charging bias Vc. However, the output characteristic of the power source 50Y outputting the charging bias Vc is not limited to this example. A power source having an output characteristic of shifting a charging bias Vc towards a negative polarity side irrespective of a target value of the charging bias Vc is possible. A power source having an output characteristic of shifting a charging bias Vc towards a positive polarity side or a negative polarity side according to a target value of the charging bias Vc is also possible.

In addition, in the example, the developing power source 51Y has the output characteristic of shifting the developing bias Vb towards a negative polarity side further than a target value of the developing bias Vb irrespective of the target value of the developing bias Vb. However, the output characteristic of the developing power source 51Y outputting the developing bias Vb is not limited to this example. A developing power source having an output characteristic of shifting a developing bias Vb towards a positive polarity side irrespective of a target value of the developing bias Vb is possible. A developing power source having an output characteristic of shifting a developing bias Vb towards a positive polarity side or a negative polarity side according to a target value of the developing bias Vb is also possible.

The following can be understood from the example shown in FIG. 10: In a case in which the target value of the developing bias Vb is −350V, an actual output value of the developing bias Vb is shifted 3V to the negative polarity side from the target value and is −353V. In a case in which the target value of the charging bias Vc is −1100V, an actual output value of the charging bias Vc is shifted 10V to the positive polarity side from the target value and is −1090V. A setting of the above-described cases in which the target value of the developing bias is −350V and the target value of the charging bias Vc is −1100V makes an actual background potential 13V smaller than an optimal background potential.

Further, in a case in which the target value of the developing bias Vb is −550V, an actual output value of the developing bias Vb is shifted 4V to the negative polarity side from the target value and is −554V. In a case in which the target value of the charging bias Vc is −1300V, an actual output value of the charging bias Vc is shifted 13V to the positive polarity side from the target value and is −1087V. A setting of the above-described cases in which the target value of the developing bias is −550V and the target value of the charging bias Vc is −1300V makes an actual background potential 17V smaller than an optimal background potential.

Further, in a case in which the target value of the developing bias Vb is −700V, an actual output value of the developing bias Vb is shifted 5V to the negative polarity side from the target value and is −705V. In a case in which the target value of the charging bias Vc is −1550V, an actual output value of the charging bias Vc is shifted 15V to the positive polarity side from the target value and is −1085V. A setting of the above-described cases in which the target value of the developing bias is −700V and the target value of the charging bias Vc is −1550V makes an actual background potential becomes 20V smaller than an optimal background potential.

In general, the operational life of the power source 50Y and the developing power source 51Y is approximately the same. Thus, in a case in which the power source SOY has reached the end of its operational life, it is preferable to replace not only the power source SOY but also the developing power source 51Y. Thus, in the printer 100, as a rule the power source 50Y and the developing power source 51Y are replaced as a set. The rule also applies to sets of the power source 50C and the developing power source 51C, the power source 50M and the developing power source 51M, and the power source 50K and the developing power source 51K. An operation in which one of the power sources 50Y, 50C, 50M, and 50K or one of the developing power sources 51Y, 51C, 51M, and 51K is supplied alone to a user is not conducted.

In an operation in which the above-described rule of replacement is employed, an amount of deviation of an actual background potential from an optimal background potential may be determined from a combination of a target value of the charging bias Vc and a target value of the developing bias Vb.

In the printer 100, an adjustment value algorithm is stored in the nonvolatile memory 30*c* of the controller 30 for each of the image forming units 1Y, 1C, 1M, and 1K. The adjustment value algorithm is an algorithm to determine, based on a combination of a target value of the charging bias Vc and a target value of the developing bias Vb, an adjustment value for the target value of the charging bias Vc or an adjustment value for the target value of the developing bias Vb. The adjustment value algorithm is formed according to tests employing an actually mounted combination of the power sources 50Y, 50C, 50M, and 50K and the developing power sources 51Y, 51C, 51M, and 51K in the printer 100.

In a case in which the power source 50Y and the developing bias 51Y has output characteristics as shown in FIG. 10, an adjustment value is determined as follows. For example, with respect to a combination of the target value of the developing bias Vb being −550V and the target value of the charging bias Vc being −1300V, an adjustment value of −17V for the charging bias Vc or an adjustment value of 17V for the developing bias Vb is determined. Then, the controller 30 adds the adjustment value of −17V for the charging bias Vc to a target value of the charging bias Vc or adds the adjustment value of 17V for the developing bias Vb to a target value of the developing bias Vb. With either of the above-described adding, the actual background potential becomes 17V larger and is adjusted to approximately the optimal background potential.

With the above-described configuration, there is no need to store the following two algorithms in the nonvolatile memory 30*c*. The two algorithms are the above-described first algorithm to determine the amount of deviation of an actual value of the charging bias Vc from a target value of the charging bias Vc and the above-described second algorithm to determine the amount of deviation of an actual value of the developing bias Vb from a target value of the developing bias Vb.

Instead of the above-described two algorithms, the adjustment value algorithm is stored in the nonvolatile memory 30*c*.

In comparison to storing the above-described two algorithms, storing the adjustment value algorithm obtains a reduction of increase in occupying amount of storage capacity of the nonvolatile memory 30*c*. In addition, there is no need to conduct calculation based on each of the above-described two algorithms. Calculation is based on the adjustment value algorithm. Accordingly, compared to employing the above-described two algorithms, calculation time of an adjustment value is shortened and a need for faster processing by the CPU 30*a* is reduced. As a result, compared to employing the above-described two algorithms, reduction in cost increase of the controller 30 is obtained, and generation of background fogging or carrier adhesion due to output error with respect to the charging bias Vc or the developing bias Vb is suppressed.

The following table 1 shows a relation between an amount of deviation of the charging bias Vc, an amount of deviation of the developing bias Vb, a charging potential Vd, an amount of deviation of the background potential, and an adjustment value R determined with the adjustment value algorithm. With respect to table 1, a target value of the charging bias Vc is −1500V and a target value of the developing bias Vb is −550.

TABLE 1

| | Example number | | | |
|---|---|---|---|---|
| | 1 | 2 | 3 | 4 |
| Deviation amount of charging bias [V] | 15 | −15 | 15 | −15 |
| Deviation amount of the developing bias [V] | −5 | 5 | 5 | −5 |
| Actual charging potential Vd [V] | 685 | 715 | 685 | 715 |
| Actual developing bias Vb [V] | 555 | 545 | 545 | 555 |
| Actual background potential [V] | 130 | 170 | 140 | 160 |

TABLE 1-continued

| | Example number | | | |
|---|---|---|---|---|
| | 1 | 2 | 3 | 4 |
| Deviation amount of the background potential | 20 V smaller | 20 V larger | 10 V smaller | 10 V larger |
| Adjustment value R [V] | −20 | 20 | −10 | 10 |

Example number 1 of Table 1 is a case in which an actual output value of the charging bias Vc has deviated 15V to the positive polarity side from the target value, and an actual output value of the developing bias Vb has deviated 5V to the negative polarity side from the target value. In the case of example number 1, an actual background potential becomes 20V smaller than an optimal background potential. A shift of just 20V with respect to the charging bias Vc to the negative polarity side is needed to make the actual background potential 20V larger. Thus, the target value of the charging bias Vc is adjusted by adding the adjustment value R of −20 determined with the adjustment value algorithm.

Example number 2 of Table 1 is a case in which an actual output value of the charging bias Vc has deviated 15V to the negative polarity side from the target value, and an actual output value of the developing bias Vb has deviated 5V to the positive polarity side from the target value. In the case of example number 2, an actual background potential becomes 20V larger than an optimal background potential. A shift of just 20V with respect to the charging bias Vc to the positive polarity side is needed to make the actual background potential 20V smaller. Thus, the target value of the charging bias Vc is adjusted by adding the adjustment value R of 20 determined with the adjustment value algorithm.

Example number 3 of Table 1 is a case in which an actual output value of the charging bias Vc has deviated 15V to the positive polarity side from the target value, and an actual output value of the developing bias Vb has deviated 5V to the positive polarity side from the target value. In the case of example number 3, an actual background potential becomes 10V smaller than an optimal background potential. A shift of just 10V with respect to the charging bias Vc to the negative polarity side is needed to make the actual background potential 10V larger. Thus, the target value of the charging bias Vc is adjusted by adding the adjustment value R of −10 determined with the adjustment value algorithm.

Example number 4 of Table 1 is a case in which an actual output value of the charging bias Vc has deviated 15V to the negative polarity side from the target value, and an actual output value of the developing bias Vb has deviated 5V to the negative polarity side from the target value. In the case of example number 4, an actual background potential becomes 10V larger than an optimal background potential. A shift of just 10V with respect to the charging bias Vc to the positive polarity side is needed to make the actual background potential 10V smaller. Thus, the target value of the charging bias Vc is adjusted by adding the adjustment value R of 10 determined with the adjustment value algorithm.

As described above, irrespective of polarity (i.e., positive, negative) of the amount of deviation of the charging bias Vc or to polarity of the amount of the deviation of the developing bias Vb, by adding the adjustment value R determined with the adjustment value algorithm to the target value of the charging bias Vc, the optimal background potential is obtained.

The above-described examples describe adjustment with respect to the target value of the charging bias Vc. However, it is to be noted that adjustment with respect to the target value of the developing bias Vb is the same as adjustment with respect to the target value of the charging bias Vc.

Thus, the controller 30 determines, with respect to each color of yellow, cyan, magenta, and black, the adjustment value R with the setting value (i.e., target value) of the charging bias Vc and the setting value (i.e., target value) of the developing bias Vb determined in the process control, and the adjustment value algorithm. Then, with respect to each color of yellow, cyan, magenta, and black, adjustment of either the target value of the charging bias Vc or the target value of the developing bias Vb is conducted with the determined adjustment value R of each color of yellow, cyan, magenta, and black. With this adjustment, generation of background fogging or carrier adhesion caused by output error with respect to the charging bias Vc or the developing bias Vb are suppressed. In addition, with the above-described configuration, there is no need to have an operator of a factory separately store multiple algorithms in the nonvolatile memory 30*c* of the controller 30. Instead, just the adjustment value algorithm is stored in the nonvolatile memory 30*c*. Workload of the operator is lightened and manufacturing costs are held down.

It is to be noted that replacement of the combination of the power source and the developing power source is conducted by a service man of a maintenance organization due to hassle of replacement by a user. A new combination of the power source and the developing power source is packed as a set. Included in the pack is a recording medium (e.g., CD-ROM, etc.) that stores an adjustment value algorithm formed from tests of the packed new combination of the power source and the developing power source. When replacing, after installing the new combination of the power source and the developing power source, the service man connects a notebook computer to the printer 100 with a LAN cable via a LAN port provided in the printer 100. Then, after loading the adjustment value algorithm stored in the recording medium into the notebook computer, an exclusive use program is booted. Via the notebook computer, the adjustment value algorithm stored in the nonvolatile memory 30*c* of the printer 100 is rewritten to correspond with the installed new combination of the power source and the developing power source.

The following is a description of a configuration of a copier serving as the embodiment of the printer 100 with added features, and has the same configuration as the printer 100 unless explicitly described otherwise below.

In the printer 100, the adjustment value algorithm is stored in the nonvolatile memory 30*c* to accurately obtain an amount of deviation of the charging bias Vc and an amount of deviation of the developing bias Vb irrespective of a target value of the charging bias Vc and a target value of the developing bias Vb. Generally, due to the adjustment value algorithm being complicated and having a large amount of information, manual writing of the adjustment value algorithm into the nonvolatile memory 30*c* is difficult. Accordingly, when the combination of the power source and the developing power source are replaced, the adjustment value algorithm stored in the recording medium that corresponds to the combination is read from the recording medium into the notebook computer and transferred to the nonvolatile memory 30*c*. Accordingly, with respect to maintenance, there is a maintenance inconvenience in the form of a need to prepare the notebook computer for rewriting the adjustment value algorithm. Further, increase in cost is generated due to packaging the recording medium storing the adjustment value algorithm with the new combination of the power source and the developing power source.

Regarding an output error (i.e., amount of deviation from a target value) with respect to the charging bias Vc or an output error (i.e., amount of deviation from a target value) with respect to the developing bias Vb, the output error does not necessarily have to be made zero. As described above, in the printer 100 according to an embodiment of the present invention, there is a possibility of deviation of +−68V at maximum with respect to the background potential from an optimal background potential. However, depending upon specifications of the printer 100 and the employed power sources and the employed developing power sources, there is a case in which the above-described deviation of the background potential becomes smaller. In such a case, instead of determining an adjustment value R corresponding to a target value of the charging bias Vc and a target value of the developing bias Vb for each of the combinations of the power source and the developing power source of each color of yellow, cyan, magenta, and black, employing a single common adjustment value R with respect to the combinations of the power source and the developing power source of each color of yellow, cyan, magenta, and black may obtain an amount of deviation of the background potential held within a predetermined range. In other words, by employing the single common adjustment value R, suppression of generation of background fogging or carrier adhesion may be obtained.

Figure 11:
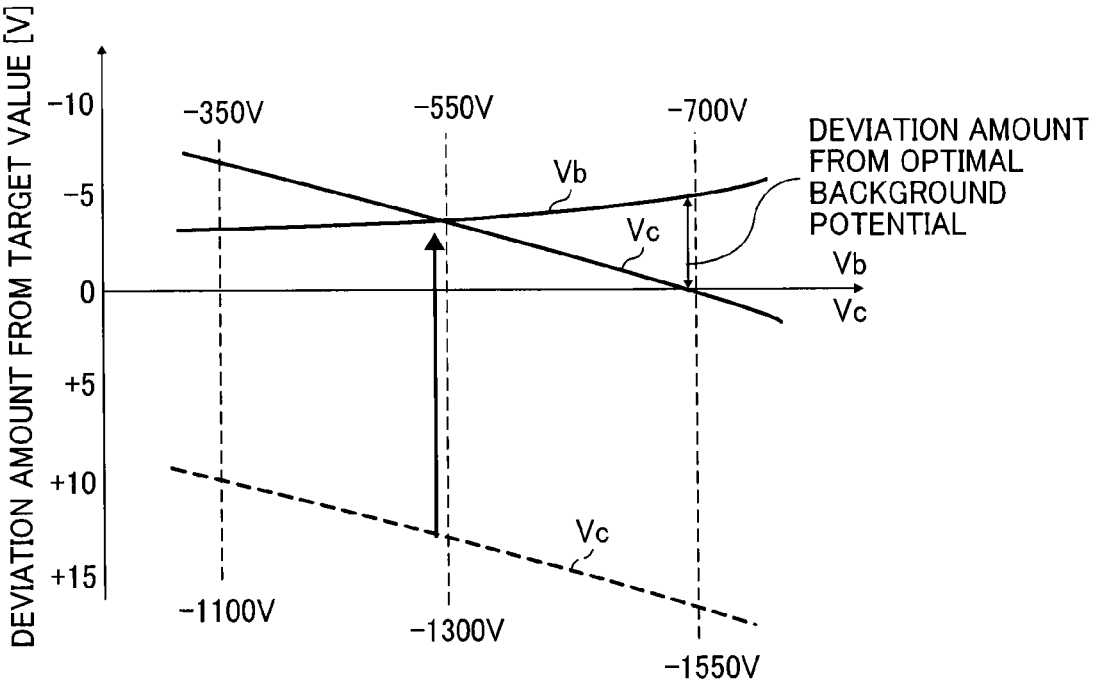
FIG. 11 is a graph showing an example of a relation between the output characteristic of the power source outputting the charging bias, the output characteristic of the developing power source outputting the developing bias, the amount of deviation of the charging bias from the target value, the amount of deviation of the developing bias from the target value, and a common adjustment value.

The following is a description of the above-described case of employing the single common adjustment value R. FIG. 11 is a graph showing an example of a relation between an output characteristic of a power source outputting a charging bias Vc, an output characteristic of a developing power source outputting a developing bias Vb, an amount of deviation of the charging bias Vc from a target value, an amount of deviation of the developing bias Vb from a target value, and a common adjustment value R. The output characteristic of the charging bias Vc is represented as a dotted line in FIG. 11. In a case in which a slope of the dotted line is comparatively small and a slope of the output characteristic of the developing bias Vb is also comparatively small, employing the single common adjustment value R is possible.

More specifically, in FIG. 11, due to an adjustment range of the developing bias Vb being −350V to −750V, a rated voltage of the developing bias Vb is approximately −550V. Due to an adjustment range of the charging bias Vc being −1100V to −1550V, a rated voltage of the charging bias Vc is approximately −1300V. Accordingly, in a combination of the developing bias Vb of approximately −550V and the charging bias Vc of approximately −1300V, an adjustment value R that makes an amount of deviation 0 with respect to a background potential from an optimal background potential is determined. The adjustment value R is a total of the amount of deviation of the developing bias Vb that is −4V and an inversion of the amount of deviation of the charging bias Vc that is 12V. The total is −16V. When −16V is employed as the common adjustment value R, irrespective of the target value of the charging bias Vc or the target value of the developing bias Vb, a value of the amount of deviation of the background potential from the optimal background potential is as follows. The value of the amount of deviation of the background potential from the optimal background potential is the same as an amount of deviation of a graph representing the output characteristic with respect to the charging bias Vc shown by a solid line in FIG. 11 and a graph representing the output characteristic with respect to the developing bias Vb. Even if the amount of deviation is at maximum, it is understood from FIG. 11 that the amount of deviation is not too large. Accordingly, with respect to the amount of deviation to a degree shown in FIG. 11, there is a high possibility that background fogging or carrier adhesion is held within an acceptable range.

In the embodiment of the printer 100 with added features, instead of the adjustment value algorithm, the predetermined common adjustment value R determined from results of tests employing the combinations of the power source and the developing power source of each color of yellow, cyan, magenta, and black is stored in the nonvolatile memory 30*c*. Accordingly, the controller 30 employs the predetermined common adjustment value R, irrespective of the target value of the charging bias Vc or the target value of the developing bias Vb, to adjust the target value of the charging bias Vc among the target value of the developing bias Vb and the target value of the charging bias Vc determined in a process control.

With the above-described configuration, there is no need to prepare the notebook computer for rewriting the adjustment value algorithm, and maintenance inconvenience is avoided. Further, there is no need to include the recording medium storing the adjustment value algorithm with the packed new combination of the power source and the developing power source, and increase in cost due to inclusion of the recording medium may be avoided.

The description thus far is one example of an embodiment of the present invention. Each aspect of the present invention exhibits particular effects as follows.

[Aspect A]

The image forming apparatus includes the electrostatic latent image bearer (e.g., the drum-shaped photoreceptor 2Y); the charger (e.g., the charging roller 3Y) to charge a surface of the electrostatic latent image bearer; the power source (e.g., the power source 50Y) to output the charging bias Vc supplied to the charger; the electrostatic latent image writing unit (e.g., the optical writing unit 6) to write the electrostatic latent image on the surface of the electrostatic latent image bearer that is charged by the charger; the developing unit (e.g., the developing device 4Y) including the developing member to develop the electrostatic latent image to obtain the toner image; the developing power source (e.g., the developing power source 51Y) to output the developing bias Vb supplied to the developing unit; the controlling mechanism (e.g., the controller 30) to conduct adjustment of the charging bias Vc output from the power source to a predetermined target value, to conduct adjustment of the developing bias Vb output from the developing power source to a predetermined target value, and to conduct the adjustment process of adjusting a target value of the charging bias Vc or adjusting a target value of the developing bias Vb at the predetermined timing to stabilize image density; and a storage unit (e.g., the nonvolatile memory 30*c*) storing the adjustment value algorithm. The adjustment value algorithm is the algorithm to determine the adjustment value that decreases the amount of deviation of the background potential from the optimal background potential, due to output error with respect to the charging bias Vc and output error with respect to the developing bias Vb, by adjusting one of the target values of the combination of the target value of the charging bias Vc adjusted in the adjustment process and the target value of the developing bias Vb adjusted in the adjustment process, the background potential being the potential difference between the surface of the developing member and the background portion of the electrostatic latent image bearer. The controlling mechanism conducts adjustment of one of the target values of the combination of the target value of the charging bias Vc adjusted in the adjustment process and the target value of the developing bias Vb adjusted in the adjustment process with the adjustment value determined with the adjustment value algorithm.

As described in the following, with the above-described configuration, generation of background fogging or carrier adhesion due to output error of the charging bias Vc or the developing bias Vb is suppressed, and increase of manufacturing cost may be suppressed. More specifically, generation of background fogging or carrier adhesion is due to the comparatively large amount of deviation of the background potential from the optimal background potential caused by output error with respect to the charging bias Vc or output error with respect to the developing bias Vb. The amount of deviation of the background potential from the optimal background potential is the amount of deviation of the output value of the charging bias Vc from the target value of the charging bias Vc superimposed with the amount of deviation of the output value of the developing bias Vb from the target value of the developing bias Vb. In the first image forming apparatus, by making the amount of deviation of the output value of the charging bias Vc from the target value of the charging bias Vc and the amount of deviation of the output value of the developing bias Vb from the target value of the developing bias Vb approach zero, respectively, the optimal value of the background potential is obtained. However, making the background potential approximately the optimal value is possible by adjusting either the target value of the charging bias Vc or the target value of the developing bias Vb. For example, in a case in which a target value of the charging bias Vc is −700V and an actual output value of the charging bias Vc is −680, and a target value of the developing bias Vb is −350V and an actual output value of the developing bias Vb is −355V, an actual background potential is 325V when an optimal background potential is 350V. An amount of deviation is −25V. When adjustment is made to the target value of the charging bias Vc by adding the amount of deviation of −25V, the actual output value of the charging bias Vc is made −705V. Accordingly, the background potential becomes approximately the optimal value 705−355=350V. Alternatively, when adjustment is made to the target value of the developing bias Vb by subtracting the amount of deviation of −25V, the actual output value of the developing bias Vb is made −330V. Accordingly, the background potential becomes approximately the optimal value 680−330=350V. Thus, in the case of adjusting either the target value of the charging bias Vc or the target value of the developing bias Vb, making the background potential approximately the optimal value is possible. The algorithm that enable the above-described adjustment may be made based on results of actual measurements of the output characteristic with respect to the charging bias Vc and the output characteristic with respect to the developing bias Vb. In the embodiment of the present invention, the algorithm is stored in the storage unit as the adjustment value algorithm, and with respect to the controlling mechanism, adjustment of one of the target values of the target value of the charging bias Vc and the target value of the developing bias Vb is conducted with the adjustment value determined with the adjustment value algorithm. With the above-described configuration, there is no need to have the operator of the factory separately store the first algorithm for adjusting the charging bias Vc and the second algorithm for adjusting the developing bias Vb in the storage unit. Instead, just the adjustment value algorithm is stored in the storage unit. Workload of the operator is lightened, and manufacturing costs are held down. In addition, generation of background fogging or carrier adhesion may be suppressed by adjusting one of the target values of the target value of the charging bias Vc and the target value of the developing bias Vb with the adjustment value determined with the adjustment value algorithm and suppressing the amount of deviation of the background potential from the optimal background potential caused by output error with respect to the charging bias Vc or output error with respect to the developing bias Vb.

[Aspect B]

Aspect B is the image forming apparatus according to aspect A in which the adjustment value algorithm is configured to determine the adjustment value decreasing the amount of deviation of the background potential from the optimal background potential by adjusting the target value of the charging bias Vc among the target value of the charging bias Vc and the target value of the developing bias Vb. The controlling mechanism conducts adjustment of the target value of the charging bias Vc with the adjustment value determined with the adjustment value algorithm.

With the above-described configuration, generation of developing failure due to adjustment may be suppressed compared to a case of adjusting the target value of the developing bias Vb. More specifically, in the embodiment of the present invention, obtaining the background potential of approximately the optimal value is possible by adjusting the target value of the charging bias Vc or the target value of the developing bias Vb. However, with respect to the developing potential that is the potential difference between the developing bias Vb and an electrostatic latent image potential, error to some extent is generated. Adjustment with respect to the target value of the developing bias Vb makes the above-described error larger compared to adjustment with respect to the target value of the charging bias Vc. The reason as to the above-described error becoming larger is as follows. The developing bias Vb is set to a value between the charging bias Vc and the electrostatic latent image potential. Error rate of output error regarding the output value of the charging bias Vc to the target value of the charging bias Vc and output error regarding the output value of the developing bias Vb to the target value of the developing bias Vb is approximately the same (e.g., +−3%). Accordingly, the amount of deviation of the output value of the charging bias Vc to the target value of the charging bias Vc is larger than the amount of deviation of the output value of the developing bias Vb to the target value of the developing bias Vb. In addition, generally, a certain margin is given to an electrostatic latent image writing intensity, and irrespective of a charging potential of an electrostatic latent image, the electrostatic latent image potential is approximately the same value. Thus, in either case of adjusting the target value of the charging bias Vc or adjusting the target value of the developing bias Vb, the electrostatic latent image potential is approximately the same value. By contrast, a value of the developing bias Vb largely differs depending upon which of the target values is adjusted among the target value of the developing bias Vb and the target value of the charging bias Vc. In a case of adjusting the target value of the charging bias Vc, the output value of the developing bias Vb is not adjusted and the value of the developing bias Vb deviates from the target value of the developing bias Vb comparable to output error of the developing bias Vb. The developing potential also deviates from the optimal developing potential comparable to output error of the developing bias Vb. On the other hand, in a case of adjusting the target value of the developing bias Vb, an amount of adjustment of the output value of the developing bias Vb is a value comparable to output error of the developing bias Vb superimposed on output error of the charging bias Vc. As a result, the output value of the developing bias Vb deviates from the target value of the developing bias Vb comparable to output error of the charging bias Vc. The developing potential also deviates from the optimal developing potential comparable to output error of the charging bias Vc. The developing potential becomes larger than the amount of deviation of the case of adjusting the target value of the developing bias Vb (i.e., =comparable to output error of the developing bias Vb). Accordingly, when the target value of the developing bias Vb is adjusted, the amount of deviation of the background potential from the optimal background potential is made larger compared to the case of adjusting the target value of the charging bias Vc and developing failure is likely to be generated. Thus, in aspect B, the target value of the charging bias Vc is adjusted. Compared to the case of adjusting the target value of the developing bias Vb, generation of developing failure due to adjustment may be suppressed.

[Aspect C]

Aspect C is the image forming apparatus according to aspect A in which the predetermined common adjustment value is stored in the storage unit instead of the adjustment value algorithm. The predetermined common adjustment value uniformly adjusts one of the target values of the combination of the target value of the charging bias Vc and the target value of the developing bias Vb irrespective of the combination of the target value of the charging bias Vc and the target value of the developing bias Vb. The controlling mechanism conducts adjustment with the predetermined common adjustment value with respect to one of the target values of the combination of the target value of the charging bias Vc and the target value of the developing bias Vb irrespective of the combination of the target value of the charging bias Vc and the target value of the developing bias Vb.

As described in the above-described embodiment, with the above-described configuration, depending upon the target value of the charging bias Vc or the target value of the developing bias Vb, the background potential might be slightly offset from the optimal background potential. However, the amount of deviation of the background potential may be held within a level in which background fogging or carrier adhesion is not generated. In addition, unlike aspect A (i.e., embodiment A), there is no need to prepare the notebook computer for rewriting the adjustment value algorithm and maintenance inconvenience is avoided. Further, there is no need to include the recording medium storing the adjustment value algorithm with the packed new combination of the power source and the developing power source, and increase in cost due to inclusion of the recording medium may be avoided.

[Aspect D]

Aspect D is the image forming apparatus according to aspect C in which the predetermined common adjustment value is stored in the storage unit. The predetermined common adjustment value adjusts the target value of the charging bias Vc among the target value of the charging bias Vc and the target value of the developing bias Vb. The controlling mechanism conducts adjustment of the target value of the charging bias Vc with the predetermined common adjustment value.

With the above-described configuration, due to the same reason as aspect B, compared to the case of adjusting the target value of the developing bias Vb, generation of developing failure due to adjustment may be suppressed.

[Aspect E]

Aspect E is the image forming apparatus according to aspect A in which the power source outputs the charging bias Vc formed of the DC bias.

[Aspect F]

Aspect F is the image forming apparatus according to aspect A including a plurality of combinations of the electrostatic latent image bearer, the charger, the power source, the developing unit, and the developing power source. Each of the plurality of combinations form a toner image of a color different from each other. The adjustment value algorithm or the adjustment value corresponding to each of the plurality of combinations is individually stored in the storage unit. The controlling mechanism conducts adjustment of the target value of the charging bias Vc or the target value of the developing bias Vb with the adjustment value algorithm or the adjustment value with respect to each of the plurality of combinations.

[Aspect G]

Aspect G is the image forming apparatus according to aspect A in which the developer employed in the developing unit includes toner and carrier.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an electrostatic latent image bearer;

a charger to charge a surface of the electrostatic latent image bearer;

a power source to output a charging bias supplied to the charger;

an electrostatic latent image writing unit to write an electrostatic latent image on the surface of the electrostatic latent image bearer charged by the charger;

a developer including a developing member to develop the electrostatic latent image to obtain a toner image;

a developing power source to output a developing bias supplied to the developer;

a memory to store an adjustment value algorithm to determine an adjustment value, the adjustment value to decrease an amount of a background potential from an optimal background potential due to output error with respect to the charging bias outputted by the power source and output error with respect to the developing bias outputted by the developing power source, the background potential being a potential difference between a surface of the developing member and a background portion of the electrostatic latent image bearer; and a processor to adjust either only the charging bias output from the power source, or only the developing bias output from the developing power source by adding the adjustment value, wherein the output error with respect to the charging bias outputted by the power source is a deviation from a target charge bias, and wherein the output error with respect to the developing bias outputted by the developing power source is a deviation from a target developing bias.

2. The image forming apparatus of claim 1, wherein the adjustment value consists of a single value.

3. The image forming apparatus of claim 1, wherein the power source outputs a DC charging bias.

4. The image forming apparatus of claim 1, wherein a plurality of combinations of the electrostatic latent image bearer, the charger, the power source, the developing unit, and the developing power source forms toner images of different colors, wherein the adjustment values for each of the plurality of combinations are stored in the memory, and wherein the processor adjusts either only the charging bias output from the power source or only the developing bias output from the developing power source by adding the adjustment value in each of the plurality of combinations.

5. The image forming apparatus of claim 1, wherein the developing unit employs developer including toner and carrier particles.

* * * * *